US010312635B2

(12) United States Patent
Zhao

(10) Patent No.: US 10,312,635 B2
(45) Date of Patent: Jun. 4, 2019

(54) CONTACT BRIDGE PUNCHED OUT AWAY FROM SHIELDING PLATE

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/854,004

(22) Filed: Dec. 26, 2017

(65) Prior Publication Data

US 2018/0183187 A1 Jun. 28, 2018

(30) Foreign Application Priority Data

Dec. 27, 2016 (CN) ..... 2016 2 1444187 U

(51) Int. Cl.

| | |
|---|---|
| ***H01R 9/03*** | (2006.01) |
| ***H01R 13/6581*** | (2011.01) |
| ***H01R 13/03*** | (2006.01) |
| ***H01R 13/516*** | (2006.01) |
| ***H01R 43/16*** | (2006.01) |
| ***H01R 43/24*** | (2006.01) |
| *H01R 13/405* | (2006.01) |
| *H01R 24/60* | (2011.01) |

(52) U.S. Cl.

CPC ..... *H01R 13/6581* (2013.01); *H01R 13/03* (2013.01); *H01R 13/516* (2013.01); *H01R 43/16* (2013.01); *H01R 43/24* (2013.01); *H01R 13/405* (2013.01); *H01R 24/60* (2013.01)

(58) Field of Classification Search

CPC ..... H01R 13/6581; H01R 13/516; H01R 13/405; H01R 13/03

USPC ..... 439/55, 83, 660, 855, 108, 607.01, 637, 439/607.4, 607.36, 607.35, 667, 607.05

See application file for complete search history.

(56) References Cited

U.S. PATENT DOCUMENTS

| | | | | |
|---|---|---|---|---|
| 9,912,106 | B2 * | 3/2018 | Yao | H01R 13/6594 |
| 9,923,286 | B2 * | 3/2018 | Cheng | H01R 9/032 |
| 9,923,310 | B2 * | 3/2018 | Kao | H01R 13/6596 |
| 2015/0229077 | A1 * | 8/2015 | Little | H01R 12/724 439/78 |
| 2017/0077654 | A1 * | 3/2017 | Yao | H01R 13/6594 |
| 2017/0155208 | A1 * | 6/2017 | Zhang | H01R 13/5216 |
| 2017/0279235 | A1 * | 9/2017 | Tada | H01R 24/60 |

(Continued)

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical connector includes a terminal module enclosed within a metallic shell. The terminal module including two contact module commonly sandwich a shielding plate therebetween. In each contact module, before forming the complete terminal module, the bridges between the contacting sections of the neighboring contacts are removed by punching in a direction from the inner hidden surface to the outer exposed surface of the contacting section of the contact. Such an outward punching results in the barbs extending away from the shielding plate after the whole terminal module is formed so as to avoid the defect due to the unexpected relatively tiny distance between the contacting sections of the contacts and the shielding plate in the mating tongue along the vertical direction.

10 Claims, 9 Drawing Sheets

(56) References Cited

U.S. PATENT DOCUMENTS

| | | | | |
|---|---|---|---|---|
| 2017/0288345 | A1* | 10/2017 | Kao | H01R 13/6596 |
| 2017/0331229 | A1* | 11/2017 | Cheng | H01R 13/6585 |
| 2017/0373408 | A1* | 12/2017 | Cheng | H01R 9/032 |
| 2017/0373438 | A1* | 12/2017 | Qiu | H01R 13/6581 |
| 2017/0373442 | A1* | 12/2017 | Qiu | H01R 13/6581 |
| 2018/0013243 | A1* | 1/2018 | Yao | H01R 43/0256 |
| 2018/0019531 | A1* | 1/2018 | Qiu | H01R 12/7088 |
| 2018/0138614 | A1* | 5/2018 | Zhao | H01R 12/721 |
| 2018/0138638 | A1* | 5/2018 | Zhao | H01R 13/6581 |
| 2018/0138641 | A1* | 5/2018 | Zhao | H01R 13/6594 |
| 2018/0138642 | A1* | 5/2018 | Kong | H01R 13/658 |
| 2018/0145461 | A1* | 5/2018 | Zhao | H01R 13/6594 |
| 2018/0151985 | A1* | 5/2018 | Zhang | H01R 13/6582 |
| 2018/0159250 | A1* | 6/2018 | Zhao | H01R 9/034 |
| 2018/0159278 | A1* | 6/2018 | Zhao | H01R 13/6597 |

* cited by examiner

CONTACT BRIDGE PUNCHED OUT AWAY FROM SHIELDING PLATE

1. FIELD OF THE DISCLOSURE

The invention is related to an electrical connector assembly, and particularly to the USB Type C connector with the contact bridges punched out in a direction away from the shielding plate.

2. DESCRIPTION OF RELATED ARTS

The USB (Universal Serial Bus) Type C connector, which is tiny and becomes popular in the cellular phone, includes a contact module enclosed within a metallic shielding shell. The contact module essentially includes an upper contact module and a lower contact module commonly sandwiching a metallic shielding plate therebetween. The upper contact module includes a plurality of upper contacts embedded within an upper insulator via an insert-molding process, and the lower contact module includes a plurality of lower contacts embedded within a lower insulator via another insert-molding process. A third insulator is further applied upon the assembled upper contact module, the lower contact module and the shielding plate therebetween to finalize the whole contact module. Anyhow, during insert-molding the upper/lower contacts with thin the upper/lower insulator, the neighboring upper/lower contacts are linked with the corresponding bridges and such bridges are removed by punching out after the upper/lower insulator is formed and the upper/lower contact module is finalized. The traditional removing way is to punch out the corresponding bridges in a direction toward the shielding plate, i.e., from the contacting surface of the contacting section of contact toward the opposite surface, for keeping the relatively smooth contact surface. Anyhow, such a way may have the possibly formed barb extend in a direction toward the shielding plate, thus inevitably risking shorting between the contact and the shielding plate, and jeopardizing the expected shielding effect. FIG. 8 shows the detailed analysis wherein in the mating tongue which has a 0.6 mm thickness S1, the regular distance S2 between the contacting section of the contact to the shielding plate is 0.175±0.05 mm. Notably, the barb due to or derived from punching for removing the bridges between the adjacent contacting sections of the contacts, is around 0.06 mm in maximum. Therefore, the worst scenario is that the regular distance S2 is equal to 0.125 mm in minimum, i.e., 0.175 mm-0.05 mm, due to the manufacturing tolerance, and the barb is 0.06 mm in maximum, so that the rear distance between the contacting section of the contact and the shielding plate will be 0.065 mm, i.e., 0.125 mm-0.06 mm. Such a tiny amount tends to result in a risky situation for the connector during signal transmission.

It is desired to provide a Type C connector with the sufficient distance between the contacting sections of the contacts and the shielding plate not less than 0.125 mm so as to maintain a relatively safe environment between the contacting sections and the shielding plate during operation.

SUMMARY OF THE DISCLOSURE

To achieve the above desire, an electrical connector assembly includes a terminal module enclosed within a metallic shielding shell. The terminal module includes a first contact module including a plurality of first contacts embedded within a first insulator via a first stage insert-molding process, and a second contact module including a plurality of second contacts embedded within a second insulator via another first stage insert-molding process. The first contact module and the second contacting module commonly sandwich a metallic shielding plate therebetween and further integrally formed within a third insulator to commonly form the complete terminal module via second stage insert-molding process wherein the first insulator, the second insulator and the third insulator commonly form the insulative housing including the base and a mating tongue extending forwardly from the base. In each contact module, before forming the complete terminal module, the bridges between the contacting sections of the neighboring contacts are removed by punching in a direction from the inner hidden surface to the outer exposed surface of the contacting section of the contact. Such an outward punching results in the barbs extending away from the shielding plate after the whole terminal module is formed so as to avoid the defect due to the unexpected relatively tiny distance between the contacting sections of the contacts and the shielding plate in the mating tongue along the vertical direction.

DETAILED DESCRIPTION OF THE PREFERRED EMBODIMENT

Figure 1:
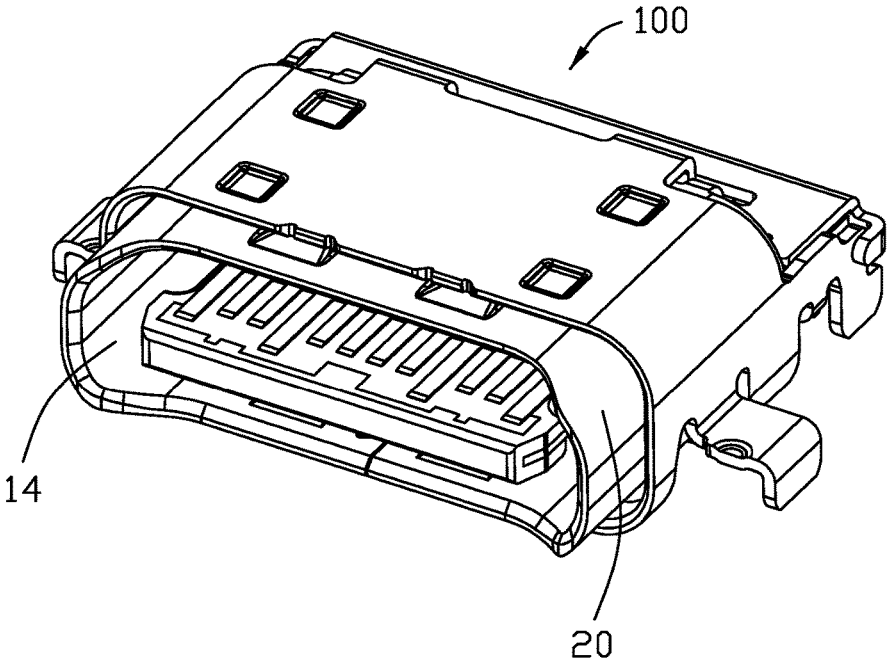
FIG. 1 is a perspective view of the electrical connector of the invention.
Figure 2:
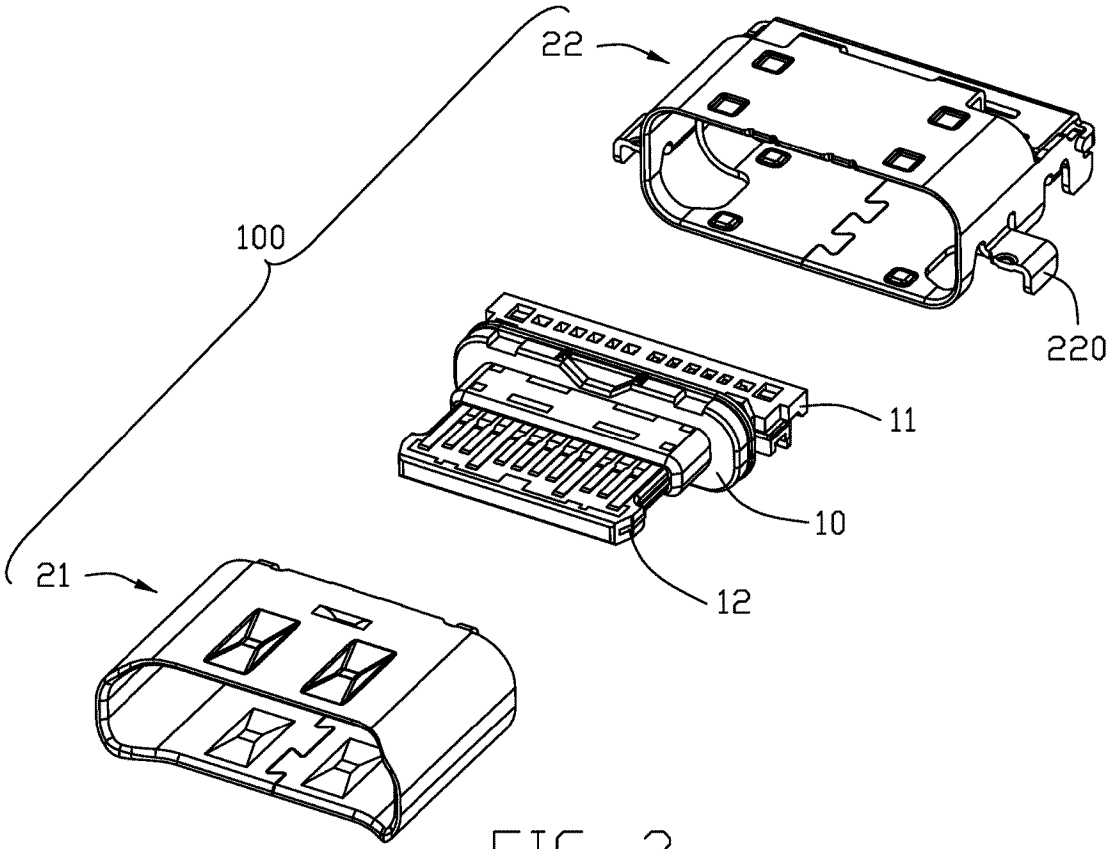
FIG. 2 is an exploded perspective view of the electrical connector of FIG. 1.
Figure 3:
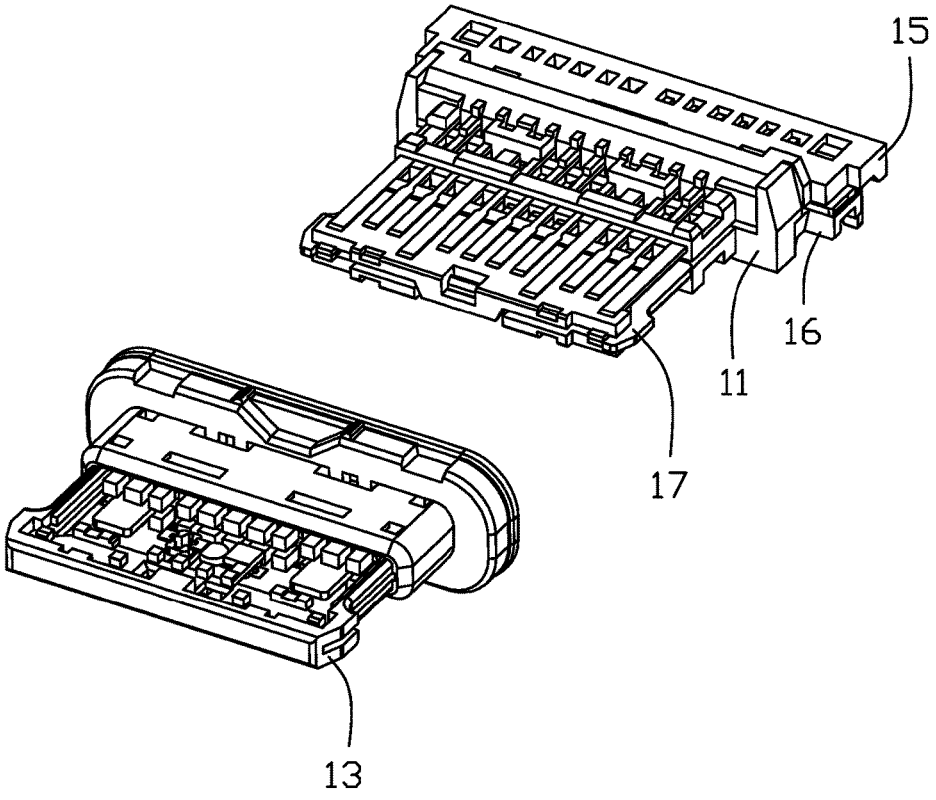
FIG. 3 is an exploded perspective view of the terminal module of the electrical connector of FIG. 1.

Reference will now be made in detail to the embodiments of the present disclosure. Referring to FIGS. 1-8, an electrical connector 100 includes a terminal module 10 and a metallic shielding shell 20 enclosing the terminal module 10. The shielding shell 20 includes a first/inner shell 21 and a second/outer shell 22 enclosing the first/inner shell 21. The second/outer shell 22 has the legs 220 for mounting to the printed circuit board (not shown).

The terminal module 10 includes a first/upper contact module 15, a second/lower contact module 16 and a metallic shielding plate 17 therebetween. The first contact module 15 includes a first/upper insulator 151 and a plurality of first/upper contacts 152 embedded within the first insulator 151 via a first stage insert-molding process. The second contact module 16 includes a second/lower insulator 161 and a plurality of second/lower contacts 162 embedded within the second insulator 161 via another first stage insert-molding process. The first contact module 115, the second contact module 16 and the shielding plate 17 therebetween are commonly integrally formed with a third insulator or an insulative cover 13 via a second stage insert-molding process. Notably, the first insulator 151, the second insulator 161 and the third insulator 13 common form an insulative housing including a rear base 11 and a front mating tongue 12 extending forwardly from the base 11. The shell 20 forms a mating cavity 14 in which the mating tongue 12 extends. The second insulator 161 includes latches 166 engaged within the holes 156 in the first insulator 151 for assembling the first contact module 15 and the second contact module 16 together.

Figure 4:
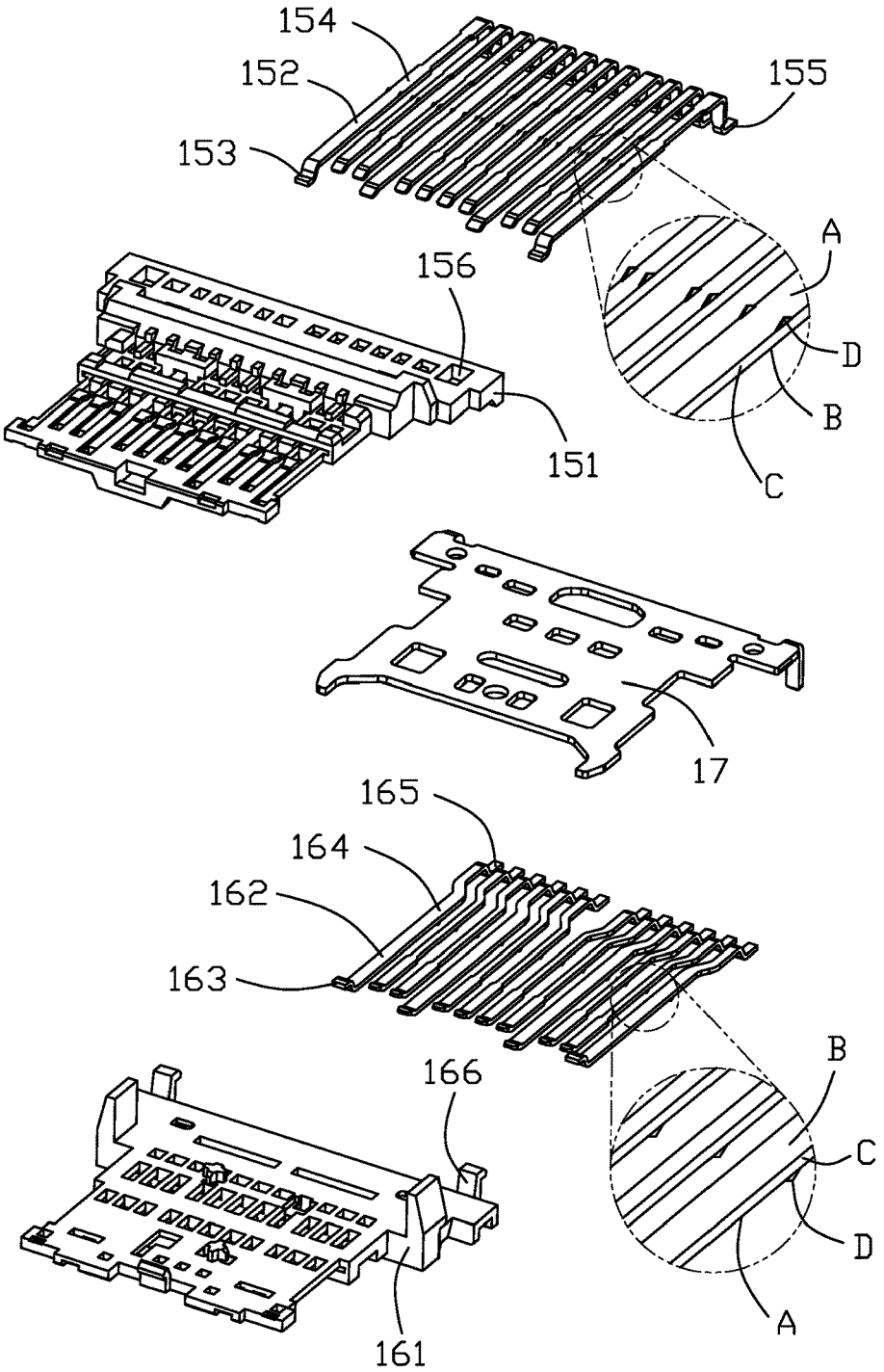
FIG. 4 is a further exploded perspective view of the terminal module of the electrical connector of FIG. 3 without the third insulator thereof.
Figure 5:
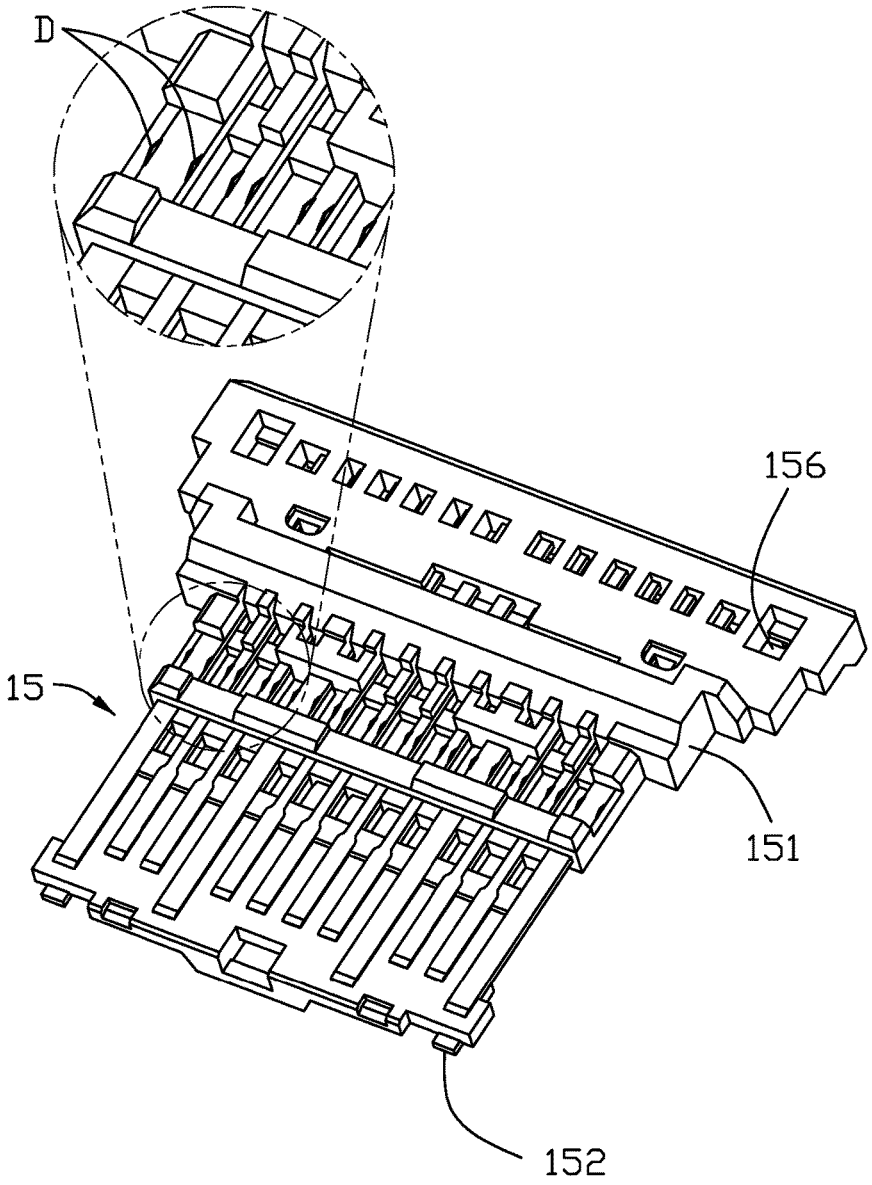
FIG. 5 is a perspective view of the first contact module of the terminal module of the electrical connector of FIG. 3.
Figure 5A:
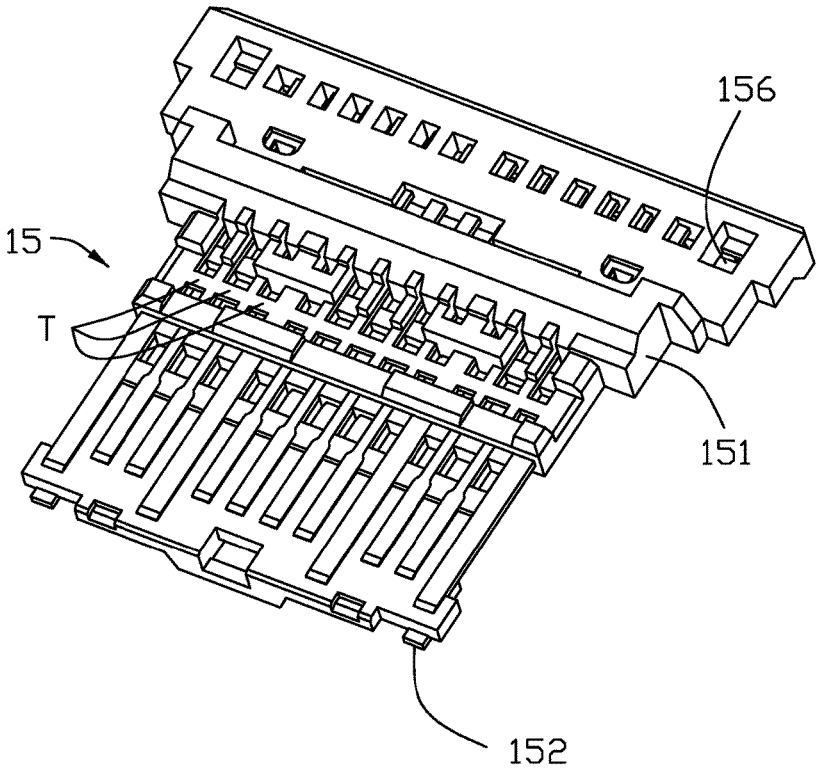
FIG. 5(A) is a perspective view of the first contact module of the electrical connector of FIG. 1 wherein the bridges are not removed therefrom.
Figure 6:
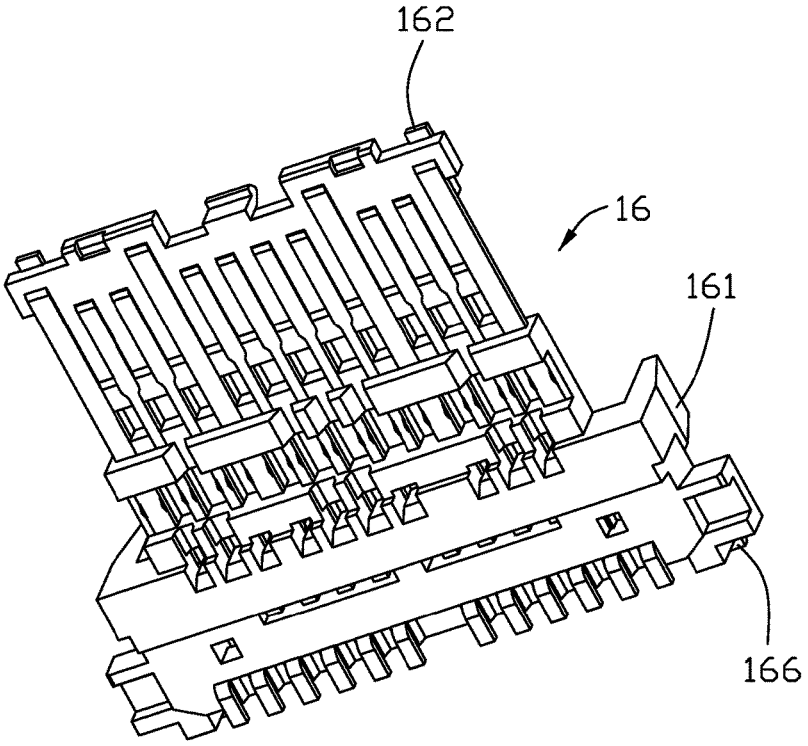
FIG. 6 is a perspective view of the second contact module of the terminal module of the electrical connector of FIG. 3.
Figure 7:
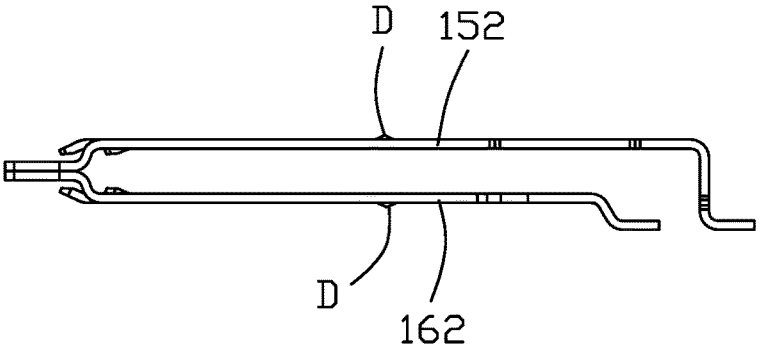
FIG. 7 is a side view of the contacting sections of the contacts of the first contact module and that of the second contact module of the terminal module of the electrical connector of FIG. 3.
Figure 8:
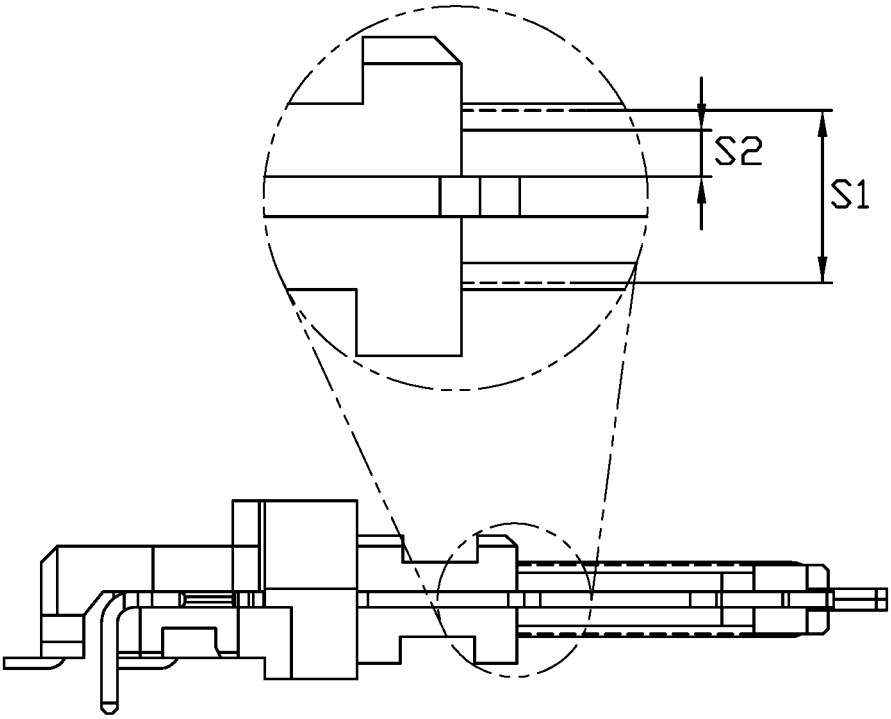
FIG. 8 is a side view of the terminal module of the electrical connector used in the traditional design.

Similar to the traditional connector, the first contact 152 includes a front first contacting section 153 exposed upon the corresponding first/upper surface (not labeled) of the mating tongue 12, a middle first retaining section 154 in the base 11, and a rear first soldering section 155 exposed outside of the housing. Similarly, the second contact 162 has the front second contacting section 163 exposed upon the second/power surface of the mating tongue 12, the middle second retaining section 164 in the base 11, and a rear second soldering section 165 outside of the housing, as well. Referring to FIGS. 4 and 5, the contacting section 153/163 of each contact 152/162 on the mating tongue 12 has an outer/exposed surface A away from the shielding plate 17, an inner/hidden surface B opposite to the surface A and facing toward the shielding plate 17, and a pair of side surfaces C linking the surface A and the surface B. A plurality of bridges T are unitarily linked between the contacting sections 153 of the neighboring first/second contacts 152/162, respectively, for regulating the contacting sections 153 not to be messed up during the high pressure insert-molding process. Understandably, there are a plurality of through holes (not labeled) in the first insulator 151 and the second insulator 161, in which the bridges T are located, for allowing the puncher to extend therethrough for removing the corresponding bridges T. After removal of such bridges T, a plurality of barbs D are formed upon the corresponding side surfaces C.

Notably, because the bridges T are removed by punching outwardly in a vertical direction away from the shielding plate 17, i.e., upwardly for the first/upper contact module 15 and downwardly for the second/lower contact module 16, the barbs D will not extend toward the shielding plate 17 to decrease the distance between the upper/lower contact 152/162 and the shielding plate 17. Therefore, the worst scenario regarding the distance between the upper/lower contacts 152/162 and the distance is not less than 0.125 mm, thus assuring the performance of the whole connector.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a terminal module enclosed within a metallic shielding shell, the terminal module including a first contact module positioned intimately upon a metallic shielding plate in said vertical direction, the first contact module including a first insulator and a plurality of first contacts integrally formed with the first insulator via an insert-molding process, each of said first contacts including a first contacting section, a plurality of bridges originally formed between every adjacent two contacting sections of the first contacts, a plurality of through holes formed in the first insulator, the bridges located in the corresponding through holes, respectively; wherein the bridges are removed by punching outwardly in a direction away from the shielding plate so as to leave corresponding barbs not to extend toward said shielding plate for keeping safe distance between the contacting sections of the first contacts and the shielding plate in said vertical direction; wherein the metallic shielding plate is integrally formed with the first contact module via an over-molding process.

2. The electrical connector as claimed in claim 1, wherein said terminal module further including a second contact module cooperating with the first contact module to commonly sandwich the shielding plate therebetween in the vertical direction, and similar to the first contact module, said second contact module has a second insulator and a plurality of second contacts integrally formed with the second insulator via another insert-molding process, each of said second contact having a contacting sections, a plurality of bridges originally formed between every adjacent two contacting sections of the second contacts, a plurality of through holes formed in the second insulator, in which the corresponding bridges of the second contact module are located, wherein the bridges are removed by punching outwardly in a direction away from the shielding plate so as to leave corresponding barbs of the second module not to extend toward said shielding plate for keeping safe distance between the contacting sections of the second contacts and the shielding plate in said vertical direction.

3. The electrical connector as claimed in claim 2, wherein the direction along which the bridges of the first contact module are punched is opposite to the direction along which the bridge of the second contact module are punched.

4. The electrical connector as claimed in claim 2, wherein said first contact module is discrete from the first contact module while commonly integrally formed within a third insulator via said over-molding process.

5. The electrical connector as claimed in claim 4, wherein said third insulator is integrally formed with all the first contact module, the second contact module and the shielding plate to complete the whole terminal module, wherein the terminal module includes an insulative housing including the first insulator, the second insulator and the third insulator, and a plurality of contacts including the first contacts and the second contacts, and wherein the housing including a base and a mating tongue extending forwardly from the base, and said mating tongue defines opposite first and second mating surfaces on which the contacting sections of the first contacts and those of the second contacts are exposed.

6. An electrical connector comprising:

a terminal module enclosing within a metallic shielding shell;

said terminal module including an insulative housing and a plurality of contact integrally formed within the housing via insert-molding, the housing including a base and a mating tongue forwardly extending from the base and defining opposite first and second mating surfaces, each of the contacts including a front contacting sections exposed upon the corresponding mating surface of the mating tongue, a plurality of bridges originally formed between every adjacent two contacting sections, respectively, a plurality of through holes formed in the mating tongue, the bridges located in the corresponding through holes, respectively, and a metallic shielding plate integrally formed within the housing and wherein a plurality of barbs are formed on the corresponding contacting sections after the bridges are removed by punching outward in a direction away from the shielding plate, and said barbs extend away from the shielding plate without decreasing a distance between the contacting sections and the shielding plate.

7. The electrical connector as claimed in claim 6, wherein the contacts are arrange with two rows having the corresponding contacting sections respectively located upon the corresponding mating surfaces of the mating tongue, and the barbs formed on the contacting sections of the contacts on one mating surface and those formed on the contacting sections of the contacts on the other mating surface extend opposite to each other in a vertical direction.

8. The electrical connector as claimed in clam 7, wherein the contacts of said one row are integrally formed within a first insulator via an insert-molding process, and the contacts of the other row are integrally formed within a second insulator via another insert-molding process, and said first insulator, said second insulator and the shielding plate are commonly formed within a third insulator via another insert-molding process.

9. An electrical connector comprising:

a terminal module enclosing within a metallic shielding shell, said terminal module defining opposite mating surfaces and including at least one contact module intimately positioned upon a metallic shielding plate, said contact module including a plurality of first contacts integrally formed within a first insulator via an insert-molding process, each of said first contacts including a contacting section exposed upon the corresponding mating surface, a plurality of bridges respectively formed between adjacent two contacting sections, a plurality of through holes formed in the first insulator, said bridges located within the corresponding through holes, wherein a plurality of barbs are formed on the corresponding contacting sections after the bridges are removed by punching outward in a direction from an hidden surface of the contacting section to an exposed surface of the contacting section, so that said barbs extend away from the shielding plate without decreasing a distance between the contacting sections and the shielding plate.

10. The electrical connector as claimed in claim 9, wherein said terminal module further including a second contact module having a plurality of second contacts integrally formed within a second insulator via another insert-molding process, wherein each of said second contacts including a contacting section exposed upon the other mating surface so as to cooperate with the contacting section of the first contacts are have the shielding plate located therebetween, a plurality of barbs due to removal of corresponding bridges of the second contacts, formed on the contacting sections of the second contacts and extending away from the shielding plate.

* * * * *